United States Patent [19]

Heffner et al.

[11] 4,400,251

[45] Aug. 23, 1983

[54] METHOD AND APPARATUS FOR SIMULTANEOUSLY ELECTROCOATING THE INTERIOR AND EXTERIOR OF A METAL CONTAINER

[75] Inventors: Robert E. Heffner, Lower Burrell; John J. Davidson, New Kensington, both of Pa.

[73] Assignee: Aluminum Company of America, Pittsburgh, Pa.

[21] Appl. No.: 270,612

[22] Filed: Jun. 5, 1981

[51] Int. Cl.[3] ..... C25D 13/04; C25D 13/14

[52] U.S. Cl. ..... 204/181 R; 204/181 C; 204/299 EC; 204/300 EC

[58] Field of Search ..... 204/181 R, 181 C, 300 EC, 204/299 EC

[56] References Cited

U.S. PATENT DOCUMENTS

| | | | |
|---|---|---|---|
| 3,922,213 | 11/1975 | Smith et al. | 204/181 |
| 4,094,760 | 6/1978 | Smith et al. | 204/181 R |
| 4,210,507 | 7/1980 | Davidson et al. | 204/181 R |
| 4,246,088 | 1/1981 | Murphy et al. | 204/181 R |

*Primary Examiner*—Howard S. Williams

*Attorney, Agent, or Firm*—David W. Brownlee

[57] ABSTRACT

A method and apparatus are provided for electrocoating the interior and exterior of a metal container using a dual flow system. The interior and exterior surfaces of the metal container may be coated with the same or different coating weights. An electrically conductive probe, including a nozzle, is inserted into a metal container and an electrically conductive housing is enclosed around the container to seal the container therein. Two separate passageways are provided such that one passageway supplies coating material about the container between the container exterior and the outer housing and a second passageway is formed by the hollow probe and the interior of the container. Electrocoating material is caused to flow into each of the passageways. As flowing electrocoating material floods the container interior and exterior in separate transient baths, an electrical potential is impressed between the container and the probe-nozzle to electrocoat the interior of the container, and between the container and the outer housing to electrocoat the exterior of the container. The interior and exterior of the container can be coated simultaneously.

8 Claims, 3 Drawing Figures

METHOD AND APPARATUS FOR SIMULTANEOUSLY ELECTROCOATING THE INTERIOR AND EXTERIOR OF A METAL CONTAINER

BACKGROUND OF THE INVENTION

This invention relates to electrocoating of metal containers. More particularly, the invention relates to a dual flow system of electrocoating the interior and exterior of a metal container simultaneously.

Usually, metal containers, such as cans and the like, have their interior surfaces and exterior surfaces coated in separate operations. The interior coating is usually applied at a thicker coating weight than the subsequently applied exterior coating. The thicker interior coating is required for protection of the container from its contents and protection of the contents of the container from reaction with the metal, while the thinner exterior coating may improve handling of the container and/or its aesthetic appearance. Additionally, an exterior coating can offer protection against the container environment, such as by inhibiting the rusting of steel and tin-free steel containers in moist atmospheres and the forming of excessive oxide on aluminum containers during retort.

The coating materials may be applied by sprays, rolls, immersion or the like using conventional polymer systems or by using electrocoating techniques. Electrocoating can provide uniform and consistent films and is a desirable approach. As used herein, electrocoating is the electrodeposition of resinous coating materials, preferably organic, on electrically conductive surface areas from either anodic or cathodic electrocoating material mediums. A layer of particulate coating material is electrodeposited on an electrically charged metal substrate immersed or surrounded in the coating material as an electrical potential is impressed between the substrate and an oppositely electrically charged electrode.

A process and apparatus for uniformly electrocoating a container is disclosed in each of U.S. Pat. Nos. 3,922,213, issued Nov. 25, 1975, and 4,094,760, issued June 13, 1978, to the common assignee of the present invention. The method and apparatus of both patents, the disclosures of which are incorporated herein by reference, considerably improved the prior techniques for electrocoating metal containers by avoiding the slower prior art processes. U.S. Pat. No. 3,922,213 relates to the uniform electrocoating of the interior of a shaped metal container, while U.S. Pat. No. 4,094,760 is an improvement thereover which permits the electrocoating of both the interior and exterior of a metal container simultaneously. Both patents disclose uniformly electrocoating the interior of a metal container which is in an inverted position by the insertion of an electrically conducting probe-nozzle therein through which coating material is flowed into the interior of the container to fill the container and maintain a transient bath of coating material therein. An electrical potential is impressed between the container and the nozzle to coat the metal surfaces. U.S. Pat. No. 4,094,760 also discloses impressing an electrical potential between the container and an outer housing to coat the exterior of the metal container simultaneously.

Though the methods and apparatus described in those patents are suitable for electrocoating metal containers in high speed production lines, there still exists the need for faster electrocoating of the interior and exterior of a metal container simultaneously in one high-speed operation. Improvements in the speed of electrocoating can result from faster filling of the electrocoating cell within which the container is housed during electrocoating than is obtainable by the monoflow system disclosed in the prior patents. Any improvements in speed also should permit application of different coating weights on the interior and exterior surfaces while achieving good coating integrity.

SUMMARY OF THE INVENTION

An object of the present invention is to provide a method and apparatus for electrocoating the interior and exterior of a metal container using a dual flow system.

Another object of the invention is to differentially electrocoat the interior and exterior of a metal container.

A further object of the invention is to electrocoat a metal container with different coatings on the interior and exterior.

Another object of the invention is to provide a method and apparatus for electrocoating the interior and exterior of a metal container simultaneously.

In accordance with the present invention, a method and apparatus are provided for electrocoating the interior and exterior of a metal container using two separate flows of electrocoating material. An electrically conductive probe, including a nozzle, is inserted into a metal container and an electrically conductive housing is enclosed around the container to seal the container therein and to form two separate passageways. A first passageway is formed by the space about the container between the container exterior and the outer housing. A second passageway is formed by the hollow probe and the interior of the container. Electrocoating material is flowed from a source through the outer housing into the first passageway to flood the container exterior in a transient bath of electrocoating material. Electrocoating material is flowed from a source through the probe into the second passageway to flood the container interior in a transient bath of electrocoating material. The probe and the outer housing may be electrically charged of the same polarity. An electrical potential is impressed between the container and the probe and between the container and the outer housing resulting in the interior and exterior surfaces of the container being electrocoated. A different coating material may be applied on the interior of the container than on the exterior of the container. Imposition of different electrical potentials results in differential coating weights on the interior and exterior of the container. The interior and exterior of the container can be electrocoated simultaneously.

DETAILED DESCRIPTION OF THE PREFERRED EMBODIMENTS

Figure 1:
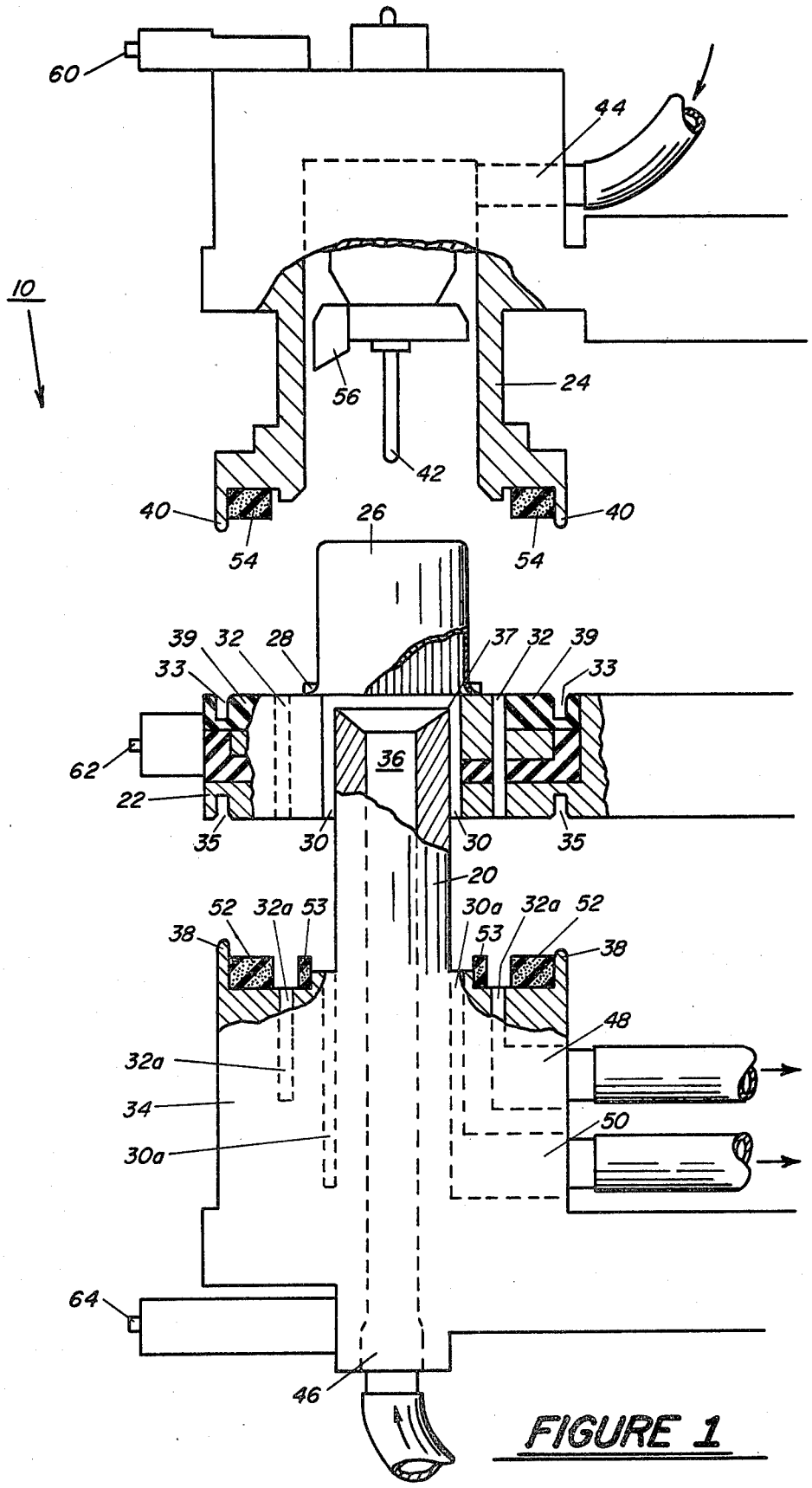
FIG. 1 is a partial crosssectional view of a preferred embodiment of the present invention.

FIG. 1 illustrates an embodiment of the apparatus of the present invention in a preferred arrangement. The apparatus or electrocoating cell 10 includes an electrode probe-nozzle 20, a container holder 22 and an outer housing 24 arranged in-line vertically with respect to one another with outer housing 24 above container holder 22 which is above probe-nozzle 20.

Container holder or can holder 22 is adapted to hold container 26 with its open end down in an inverted position. Container 26 need not be securely held to the container holder 22 but may rest in container holder 22 in a container nest 28, preferably, having a groove, recess or protrusion in its top surface which may substantially conforming to the perimeter of the open end of container 26. For containers, such as cans or the like, container nest 28 may be in the shape of an annular ring, but for containers having other than a circular open end, the container nest 28 may take the shape of the container opening. Though container holder 22 is shown and described with a nesting arrangement for retaining container 26, other embodiments are within the scope of the present invention. For example, a partial ring of less than approximately 180° in circumference could be used to frictionally fit about the container to hold it in its place. Container nest 28 may include one or more arcuate segments. In all embodiments, however, the container holder 22 has a central opening 30 therethrough to permit the insertion of an electrically conductive probe-nozzle 20 to permit electrocoating of the interior of the can. Container nest 28 which is generally concentrically and radially outward of opening 30 may be made of electrically conductive materials or insulative materials for reasons to be described below.

Container holder 22 includes opening or duct 32 which connects the upper surface of container holder 22 upon which container 26 rests and the lower surace of container holder 22. Duct 32 is located radially outwardly from central opening 30 and may be an annular opening extending substantially entirely around central opening 30 for connecting the upper surface of container holder 22 with its lower surface. In the alternative, duct 32 may be one of a plurality of bores extending through container holder 22 and located about the periphery of container nest 28 of container holder 22 and radially outwardly of central opening 30.

Figure 2:
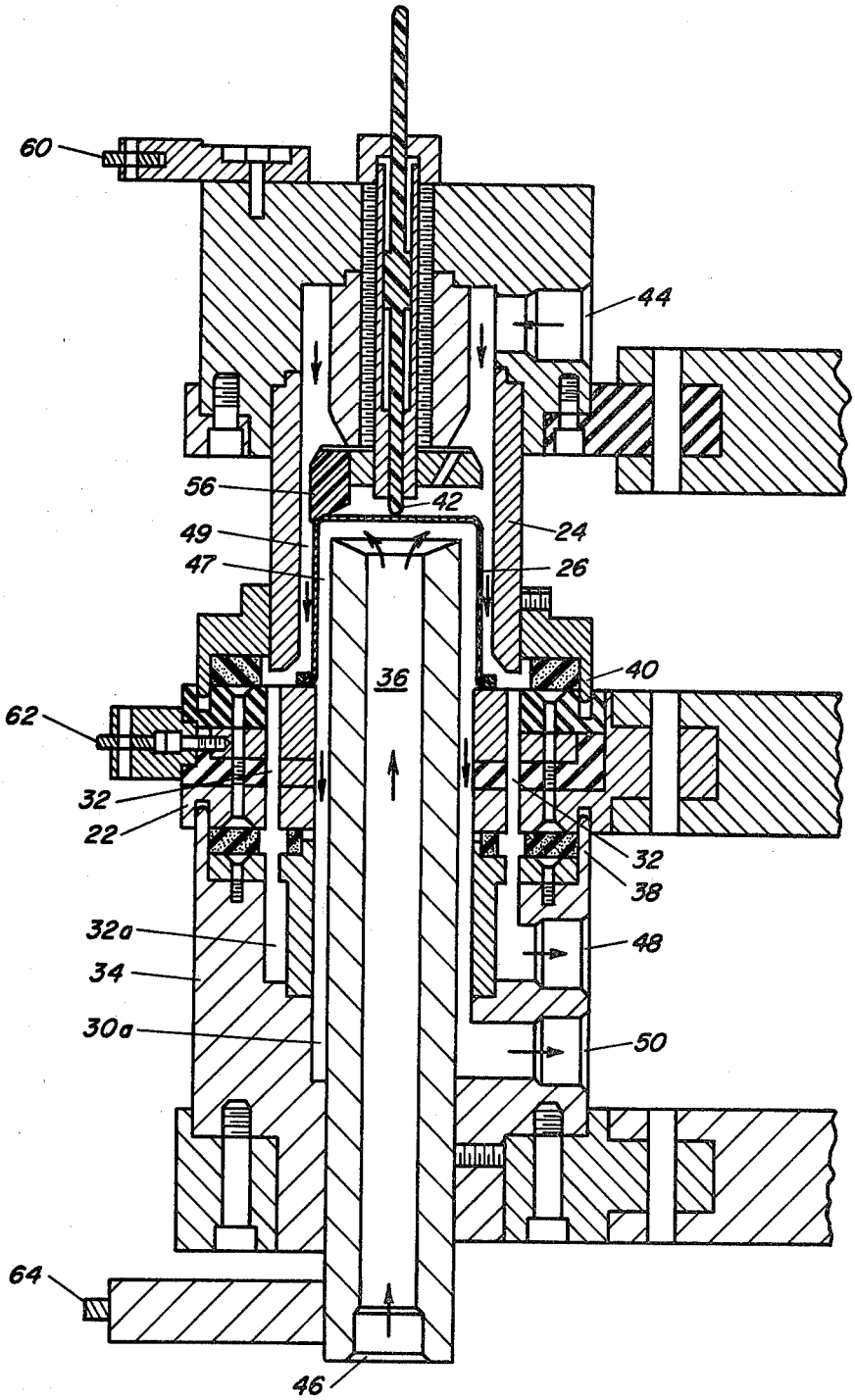
FIG. 2 is a detailed cross-sectional view of the apparatus of FIG. 1 in an electrocoating condition.

Contaiaer holder 22 also includes means on the upper and lower surfaces for detachably receiving, respectively, portions of outer housing 24 and base portion 34 of probe-nozzle 20. Such means for connection may be in the form of annular grooves 33 and 35 radially outward of the rim of container 26 and central opening 30, as shown in FIGS. 1 and 2. The upper and lower annular grooves 33 and 35, respectively, facilitate alignment and a liquid-tight seal of housing 24 and base 34 for enclosing container 26, as further shown and described with reference to FIG. 2.

Probe-nozzle 20 projects upwardly from a base portion 34. Probe 20 is hollow and may itself be a nozzle or may include nozzle portions for flowing electrocoating material into the interior of the container to be coated. Alternatively, hollow probe 20 may include an orifice and orifice portions for flowing electrocoating material out of the interior of a coated container. Preferably, probe 20 is a nozzle, as shown in FIG. 1, having a nozzle-bore 36 extending longitudinally therethrough and terminating in base 34 as port 46. Preferably, port 46 is an inlet port which is connected to a conduit for providing an electrocoating material from a source or reservoir supply. A nozzle-bore 36 may be wider at its uppermost portions, forming a narrow edge 37, and may have a generally conical or concave opening at its upper portion to aid the flow of electrocoating material into the interior of container 26. Such a wider opening also provides for an improved electrocoating on the interior of the can near the container bottom when an electrical potential is impressed between probe 20 and container 26. Narrow edge 37 improves flow patterns of electrocoating material into the container interior as well as increasing the throwing power of the bath to coat any deep recesses of the container surface.

More preferably, probe-nozzle 20 may take the configuration of the hollow electrically conductive probe disclosed in U.S. Pat. No. 4,210,507, issued July 1, 1980. The probe described in that patent includes a means for retarding the flow of the electrocoating material from the container interior by establishing an opposing flow of electrocoating material to increase the turbulence of flow without creating discontinuities of flow in order to facilitate the electrocoating of corners and recesses near the interior of the container bottom.

Probe 20 is an electrode and must be electrically conductive, preferably, generally conforms in shape to the interior of the container and is made of anti-corrosive or non-corrosive materials. As used herein, the shape of various parts of the apparatus of the present invention "generally conforms" to the container shape when the geometric shape, such as cylindrical or cubical, generally coincides though the detailed configuration, including grooves, ridges and the like, may not be present.

Base portion 34 further includes an annular chamber **30*a* and annular chamber 32*a*. Chamber 30*a* is generally concentric with the lower portion of probe-nozzle 20 within base portion 34. Chamber 32*a* is separated from and concentric with chamber 30*a* and is located generally radially outwardly therefrom. Preferably, each chamber is continuous and completely encircles probe 20 within base portion 34. In the alternative, each chamber may be a series of interconnected bores or openings about the entire periphery of probe 20. Annular chamber 30*a* merges into port 50, preferably an outlet or exhaust port near or in the lower portion of base portion 34 to permit electocoating material to flow out of base portion 34 during the electrocoating cycle only after it has flowed through the second passageway along the whole interior container surface. Annular chamber 32*a* merges into port 48, preferably an outlet or exhaust port near or in the lower portion of base portion 34 to permit the electrocoating material to flow out of base 34** during the electrocoating cycle only after it has flowed through the first passageway along the whole exterior container surface.

On the upper surface of base portion 34 is shown a sealing means 52 and sealing means 53 located radially inwardly of upward annular projections 38 which are for detachably engaging and sealing with groove 35 of container holder 22. Sealing means 52 and 53 are spaced apart in the vicinity where annular chamber **32*a* opens into the upper surface of base 34. Such spacing provides access to annular chamber 32*a* for flowing electrocoating material therethrough. Outer annular sealing means 52 and inner annular sealing means 53 are concentric and may be two separate sealing means or may be integrally formed with sufficient spacing to provide access to annular chamber 32***a*. Sealing means 52 and 53 provide a detachable, liquid-tight seal between base portion 34 and container holder 22 for retaining therein the electrocoating material during the electrocoating cycle.

Outer housing or shell 24 is an outer electrode and is electrically conductive and generally conforms to the exterior shape of the container 26 to be electrocoated. Housing 24 is larger than the container and, preferably, is also anti-corrosive. Housing 24 includes outer downward annular projections 40 for detachably engaging and sealing with the upper groove 33 of container holder 22. Extending downwardly from the interior upper wall of housing 24 is a spring contact 42 which may be centrally located such that when housing 24 encloses container 26, contact 42 is caused to retract as it contacts the bottom of container 26. One purpose of contact 42 in housing 24 is to facilitate retention of container 26 in a fixed position on container nest 28 during the electrocoating cycle.

Preferably, near or in the interior upper wall of housing 24 is at least one can bottom alignment fixture 56, preferably of nonconductive or insulative material, which also has the purpose of contacting container 26 when housing 24 encloses containers 26 to facilitate retention of the container in a fixed position on the container nest 28 during the electrocoating cycle. Fixture 56 may contact container 26 at or near the exterior bottom of the container. A plurality of fixtures 56 may be provided, for example, spaced equidistant about the periphery of the container bottom.

Near or in the upper wall of housing 24 is port 44, preferably an inlet port which permits electrocoating material to flow into housing 24 during the electrocoating cycle to flood all or part of the exterior container surface before being exhausted through duct 32 and outlet port 48. Preferably, port 44 is conducted to a conduit for providing an electrocoating material from a source or reservoir supply.

On the lower surface of outer housing 24 located radially inwardly of downward annular projections 40 are sealing means 54 to provide a detachable, liquid-tight seal between housing 24 and container holder 24 for retaining therein the electrocoating material during the electrocoating cycle.

FIG. 2 illustrates a more detailed version of the apparatus of FIG. 1 in cross section as it is in condition electrocoat. Housing 24, container 22 and base portion 34 are displaced vertically with respect to one another from the positions shown in FIG. 1 to a closed condition. Such vertical displacement can be actuated by pneumatic cylinders, cams or other conventional means, not shown.

Downward annular projections 40 of housing 24 are in place in annular groove 33 on the upper surface of container holder 22. Similarly, upward annular projections 38 of base portion 34 are shown in annular groove 35 on the lower surface of container holder 22. Container 26 is retained in position in container nest 28, such that the rim of the open end of inverted container 26 rests in container nest 28. Spring contact 42 of housing 24 is shown adjacent the bottom wall of container 26 in a retracted position so the spring is activated and exerts a downward force to retain container 26 on container nest 28. Also, can bottom alignment fixture 56 is shown contacting the bottom wall of container 26 adjacent the outer periphery to retain container 26 on container nest 28 while also aligning container 26 over central opening 30 for receiving probe 20 through opening 30 and into container 26.

When housing 24, container holder 22, and base portion 34 are displaced vertically into a closed condition, as shown in FIG. 2, two separate passageways are provided for electrocoating separately the interior surface and exterior surface of the container. In such a closed condition, spaces 47 and 49 are defined. Space 47 is formed between the probe-nozzle 20 and the interior surfaces of container 26. Space 49 is formed between the outer surface of container 26 and the inner surface of housing 24. The arrangement shown in FIG. 2 provides for a first passageway, including space 49, formed from inlet port 44 to space 49 and through duct 32 to annular chamber 32*a* and outlet port 48. A second passageway, including space 47, is formed from nozzle-bore or orifice 36 to space 47 and through annular chamber 30*a* to outlet port 50. The first passageway permits a flow of electrocoating material from inlet port 44 to outlet port 48 during the electrocoating cycle while allowing the entire passageway, including space 49, duct 32 and annular chamber 32*a*, to be filled with electrocoating material to subject all or part of the container exterior surfaces to a total immersion and flooding of electrocoating material. The second passageway permits a separate flow of electrocoating material from inlet port 46 to outlet port 50 during the electrocoating cycle while filling bore 36, space 47 and annular chamber 30*a* with electrocoating material to subject the entire container interior surfaces to a total immersion and flooding of electrocoating material.

Between the upper surface of container holder 22 and the lower edge of housing 24 is shown sealing means 54, and between the lower surface of container holder 22 and the upper surface of base portion 34 is shown sealing means 52 and 53. All of the sealing means provide a detachable and liquid-tight seal between housing 24, container holder 22 and base portion 34 to maintain two separate passageways near the interface of base portion 34 and container holder 22.

Figure 3:
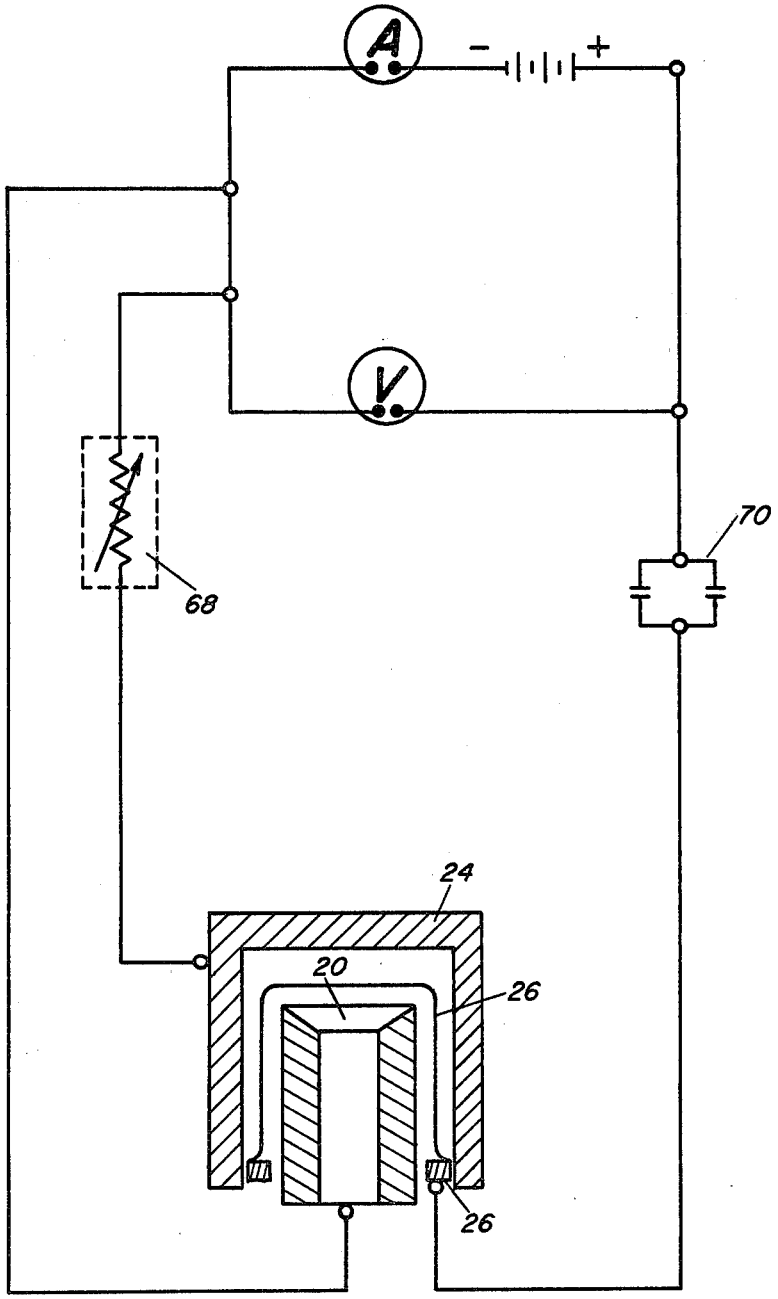
FIG. 3 is a schematic diagram of an electrical circuit of the present invention.

FIG. 3 illustrates a schematic diagram of an electrical circuit of the present invention. The source of direct current (DC) has one terminal thereof connected to the container 26 to be electrocoated, and the other terminal connected to both the internal or inner electrode (probe-nozzle 20) and an external or outer electrode (outer housing 24). More than one source of direct current may be used to impress the appropriate electrical potentials between the elements of the electrocoating cell 10, but only a single source is illustrated in FIG. 3. The internal and external electrodes generally are of the same polarity, whether a positive or negative charge, i.e. cathode or anode, in order to electrocoat the container as contemplated by the present invention.

FIG. 3 further illustrates a manner of supplying a different electrical potential between inner electrode 20 and container 26 than between outer electrode 24 and container 26 by providing resistance in one branch of the circuit to act as a voltage divider. Preferably, resistance is provided in the circuit between the direct current source and the outer electrode 24. Resistance may be in the form of a resistor bank or variable resistors, such as the rheostat type. Preferably, a variable resistor 68 is used for regulating the electrical current. For example, the addition of resistance in a circuit branch to outer electrode 24 with constant voltage from the source results in a lower current passing through that portion of the circuit which results in fewer coulombs and thus a lighter coating weight on the external surface of container 26. The end product, an electrocoated container 26, would have a thicker coating on the interior surface of the container than the exterior surface of the container. The thicker coating is normally desired in the industry to protect the container from the contents of the container and to protect the contents from reaction with the container.

The electrical circuit may also include an ammeter, A, and a voltmeter, V, for measuring the amperage and voltage passing through the circuit in order that an operator of the apparatus can effectively control the coating weight on both the interior and exterior of the container 26 whether or not simultaneously coated. A portion of the circuit leading to the container electrode includes a DC breaker 70 for programming the voltage cycle duration which controls the amount of coating weight applied. Though FIG. 3 illustrates the container connected to the positive terminal of the direct current source, the polarity may be reversed depending upon whether the electrocoating material is anodic or cathodic. Generally, the internal and external electrodes are of the same polarity. The direct current power supply should be sufficient to supply amperage for simultaneously coating the inside and outside of the container. When operating in a preferred embodiment of differentially and simultaneously coating the interior and exterior of a container, the power supply must be able to handle the various voltages involved.

Though a preferred embodiment of the apparatus of the present invention is illustrated in FIGS. 1 and 2, alternative embodiments can be made within the scope of the present invention.

The use and operation of the apparatus of the present invention can be understood by first reference to FIG. 1. With outer housing 24, container holder 22 and probe-nozzle 20 in a separated condition, as shown, a container 26 is placed in an inverted position on container holder 22. Container 26 rests in a container nest 28 such that central opening 30 is in alignment with the open end of the inverted container. Outer housing 24 and probe-nozzle 20 are closed vertically relative to container holder 22 to completely enclose container 26, as shown in FIG. 2.

Container 26 may be placed in an inverted position on container holder 22 in any of a variety of convenient manners. As it is desirable to adapt the apparatus of the present invention to high speed production can coating, the can may be brought into position by any variety of transfer means, including mechanical arms, rotary table or the like. For example, a rotary table may be adapted for handling 14 containers at a time. Each cell 10 would be in various stages of electrocoating as it moves around the rotary table. In order to adapt to high speed production lines, it is anticipated that the time duration between each cell could be one-tenth of a second such that from the time a can enters the rotary table until it exits would be approximately 1.4 seconds.

In a preferred manner of operation, once the apparatus is in the closed condition, the flow of electrocoating material is commenced through inlet port 46 and through nozzle-bore 36 until the electrocoating material has filled space 47 in the interior of container 26. Simultaneously, flow of electrocoating material is commenced through inlet port 44 into outer housing 24 until the electrocoating material has filled space 49 about the exterior of container 26. An electrical potential is simultaneously impressed between the container and probe 20 to electrocoat the interior of the container and simultaneously between the container and the outer housing to electrocoat the exterior of the container. Alternatively, one or both electrical potentials can be impressed before commencing flow of electrocoating material.

It is preferred that the two separate flows of electrocoating material commence simultaneously with activation of the electrical potential. From the time the cell closes, it is preferred that the voltage be activated and that the coating flow commences. The electrical potential is impressed and the coating will flow for about one second. These times are nominal figures, and actual length of time for the operation of electrocoating a particular container depends upon several variables. For complex container geometries, flowing of electrocoating material throughout the interior of the container may be more difficult and may result in longer durations or dwell times. After the container is coated, the apparatus or cell 10 is opened such that housing 24, holder 22 and probe-nozzle 20 separate vertically.

In the preferred manner of operation, the electrocoating material is provided to the apparatus from a source or reservoir supply (not shown). Two reservoirs may be used to provide a separate source of electrocoating material for coating the container interior and the container exterior. For applying a different coating on the interior than the exterior, separate sources are necessary.

In addition to the use of conforming or nonconforming nozzle configurations for electrocoating the interior of the container, the flow rate and pressure of the inflowing electrocoating material are important parameters dependent upon variables such as the geometry of the container and electrocoating apparatus. Generally, the flow rate is more important than the pressure. A controllable flow rate prevents turbulence and bubbles on the interior of the containers and allows electrocoating material to contact each point on the interior surface of the container. A pressure that is too high, however, results in an increasing velocity of electrocoating material and in the formation of bubbles, turbulence or the like which is undesirable. Thus, while probe-nozzle 20 having at least a generally conforming configuration is an advantage for electrocoating the interior of the container, it is not necessary to the function of the present invention. The method of the present invention has resulted in benefactory coating weights being applied to the interior of the container when the pressure at the nozzle entry of inflowing electrocoating material ranges from 8 to 12 psi and is approximately 10 psi, and the flow rate is approximately ½ to 2 liters per second.

Similarly, for electrocoating the exterior of the container, the flow rate and pressure of the inflowing electrocoating material are important parameters. The method of the present invention has resulted in satisfactory coating weights being applied to the exterior of the container when the pressure at the cell entrance of inflowing electrocoating material ranges from 9 to 12 psi and is approximately 10 psi. The flow rate may range from ½ to 2 liters per second.

The overall coating speed is also dependent upon the voltage used during the electrocoating cycle. The higher the voltage, the shorter the time may be that is needed to electrocoat the container. The voltage which is too high, however, may result in a rupture of the coating itself or blistering of the electrocoating, depending upon variables such as the particular coating material and the type of electrical contact with the container to be coated. It has been found that the present invention satisfactorily electrocoats containers in a wide range of voltage of direct current. The voltage may range from 50 to 250 DC volts with the preferred range being 100 to 200 volts. In addition to voltage, amperage is also controlled to maintain specific coating deposition weight. As with the voltage, a wide range of amperage has been found to work satisfactorily though a practical range may be 4 to 30 amperes per cell. The amperage is an important parameter to monitor for electrocoating material is rated by its coulomb efficiency, where one coulomb equals one ampere per second.

During the preferred electrocoating cycle, the outer housing 24, container 26 and probe nozzle 20 are all electrically charged, but are insulated from one another such that the electrocoating material acts as a conducting medium to commence electrodeposition on the container. If each element is not properly insulated, a short circuit would occur between container 26, probe-nozzle 20 and outer housing 24 resulting in improper coating. Additionally, probe-nozzle 20 and outer housing 24 must be insulated from one another for the purpose of applying differential coating weights on the internal and external surfaces. As shown in FIG. 1, portion 39 of container holder 22 in which annular groove 33 is provided is made of non-electrically conductive material. When cell 10 closes, as shown in FIG. 2, it can be seen that outer housing 24 is electrically insulated from container holder 22 and from container 26 as well as from nozzle 20 of base 34.

Each element of cell 10 is provided with an electrical contact. Housing 24 is provided with an electrical contact 60. The container nest 28 is provided with an electrical contact 62 while the probe 20 is provided with an electrical contact 64.

Preferably, container 26 is electrically charged through container nest 28 which is made of an electrically conductive material insulated from portions of container holder 22 that engage with housing 24 and base 34 in order to provide the electrical potential. Preferably, spring contact 42 for retaining container 26 is insulated from the outer housing and is made of insulative or non-conductive material. In the alternative, spring contact 42 may be the electrical contact and container nest 28 would be made of an insulating or non-conductive material.

The electrocoating material applicable to the method of the present invention preferably should be an electrophoretic coating having a relatively high coulomb efficiency of at least 10 milligrams per coulomb. The material must be able to adhere to aluminum and other metals and should be a water based or aqueous coating. Additionally, it is desirable that the coating be stable and be able to withstand the fluid flow pressures and air exposure to which it is subjected during the method of the present invention. During the coating cycle, the temperature of the bath of electrocoating material may range from 50° to 160° F. (10° to 71° C.) with a preferred range of 70° to 110° F. (21° to 43° C.).

As is an object of the present invention, the method and apparatus provide for faster coating of a container using a dual flow system of electrocoating material than is available using the monoflow system of the prior art. A method and apparatus is specifically suitable for high speed production can lines for providing simultaneous electrocoating of the interior and exterior of the container. It is anticipated that a 14 cell rotary machine using the dual flow system of the present invention will be able to coat in excess of 450 cans per minute with an internal surface coating weight of at least 6.5 milligrams per inch squared. In such a rotary machine, the time between cell stations in the 14 cell may be about 0.1 second. A rotary machine which operates according to such guidelines should be able to coat at a rate of about 32 cans per minute per cell. Cans coated by the method and apparatus of the present invention have exhibited coatings with very low and usually zero enamel ratings. The enamel rating essentially measures the electrical conductivity through the coating. Coatings on the container surfaces can be deposited in coating weights that may include a range of 0 to 12 milligrams per square inch. The desired coating weight will vary to provide protection from the environment in which it is intended to be used. The coating weights will be dependent upon many variables described herein, such as voltage, amperages, electrocoating material and the like.

Although preferred embodiments and alternative embodiments have been illustrated and described, it will be apparent to those skilled in the art that many changes can be made therein without departing from the scope of the invention.

Having thus described the invention, what is claimed is:

1. A method of simultaneously electrocoating the interior and exterior of a metal container, which comprises:

(a) enclosing an open-ended metal container within an outer electrically conductive housing in a spaced relation to and generally conforming with the container exterior shape to form a first passageway;

(b) providing an electrically conductive hollow electrode within said metal container and in a spaced relation to the interior surface of the container, the electrode generally conforming to the container interior, to form a second passageway;

(c) providing an electrical contact for electrically charging the metal container through the rim of the open end of the metal container;

(d) electrically insulating each of the hollow electrode, the outer housing and the metal container from one another;

(e) providing a liquid-tight seal between the first passageway and the second passageway to form two separate and unconnected passageways;

(f) flowing electrocoating material into and through the first passageway unidirectionally along the exterior surface of the container sidewall from one end of the container to the other while simultaneously flowing electrocoating material into and through the second passageway unidirectionally along the interior surface of the container sidewall from one end of the container to the other employing separate inlet and outlet ports for each passageway to rapidly flood the passageways and bathe the container exterior and interior with electrocoating material; and (g) concurrently with the flooding of said passageways, impressing a first electrical potential between the outer housing and the container to electrocoat the exterior of the container while simultaneously impressing a second electrical potential between the hollow electrode and the container to electrocoat the interior of the container.

2. The method as set forth in claim 1 in which the container is positioned with its open end in a downwardly direction.

3. The method as set forth in claim 1 wherein the first electrical potential differs in magnitude from the second electrical potential to apply differential coating weights on the exterior and interior of the container.

4. The method as set forth in claim 1 or 3 wherein the electrocoating material introduced into the first passageway and the electrocoating material introduced into the second passageway are of the same coating composition.

5. The method as set forth in claim 1 or 3 wherein the electrocoating material introduced into the first passageway and the electrocoating material introduced into the second passageway are of different compositions to provide different coatings on the container interior and exterior.

6. An apparatus for simultaneously electrocoating the interior and exterior of a metal container, having:

(a) means for enclosing an open-ended metal container, said means being electrically conductive, generally conforming with the container shape and adapted to be spaced from the exterior surface of the container to form a first passageway therebetween;

(b) an electrically conductive hollow electrode for placement within said container in a spaced relation to the container interior surface and generally conforming to the container interior; said hollow electrode adapted to be in spaced relationship with the container interior to form a second passageway therebetween;

(c) means for electrically charging the metal container through the rim of the open end of the metal container;

(d) means for electrically insulating said hollow electrode, said enclosing means and the container from one another;

(e) means for providing a liquid-tight seal between the first passageway and the second passageway to form two separate and unconnected passageways;

(f) means for flowing electrocoating material into and through the first passageway unidirectionally along the exterior surface of the container sidewall from one end of the container to the other to bathe the container exterior in electrocoating material and for simultaneously flowing electrocoating material into and through the second passageway unidirectionally along the interior surface of the container sidewall from one end of the container to the other to bathe the container interior in electrocoating material, said means including separate inlet and outlet ports for each passageway for rapid flooding of the passageways; and (g) means for impressing a first electrical potential between said enclosing means and the container to electrocoat the container exterior and for simultaneously impressing a second electrical potential between the hollow electrode and the container to electrocoat the container interior.

7. The apparatus as set forth in claim 6 which is adapted to retain the container in an inverted position.

8. The apparatus as set forth in claim 6 wherein the means for impressing the electrical potentials further includes the capacity to impress the first electrical potential different in magnitude from the second electrical potential to apply differential coating weights on the exterior and interior of the container.

* * * * *